US006042418A

United States Patent [19]

Cummings

[11] Patent Number: 6,042,418

[45] Date of Patent: Mar. 28, 2000

[54] CHRISTMAS LIGHT EXTENSION CORD SYSTEM

[76] Inventor: Hennen D. Cummings, 13110 Six Forks Rd., Raleigh, N.C. 27614

[21] Appl. No.: 09/121,337

[22] Filed: Jul. 23, 1998

[51] Int. Cl.[7] ..... H01R 11/01

[52] U.S. Cl. ..... 439/505; 439/621

[58] Field of Search ..... 439/505, 502, 439/621, 622, 623, 624, 699.2

[56] References Cited

U.S. PATENT DOCUMENTS

| | | | |
|---|---|---|---|
| 2,201,045 | 5/1940 | Lundstrom | 439/505 |
| 4,705,483 | 11/1987 | Davis et al. | 439/502 |
| 5,234,360 | 8/1993 | Kramer, Jr. | 439/502 |
| 5,853,301 | 12/1998 | Wang | 439/622 |

*Primary Examiner*—Renee S. Luebke
*Assistant Examiner*—T. C. Patel

[57] ABSTRACT

A new and improved Christmas light extension cord system for extending the configurational capabilities of Christmas lights. The system includes a first wire assembly with an electrical receptacle at one end and an electrical plug at the other end and with a plurality of wires for conveying electrical current therebetween. The system is also provided with a plurality of secondary wire assemblies, each having an input end electrically coupled to the primary wire assembly and an output end terminating in a female receptacle. A plurality of third wire assemblies, each having an input end with a male connector connected to a female receptacle of the second wire assembly and an output end terminating in a light with the length of each third wire assembly being several times longer than the male connector.

9 Claims, 2 Drawing Sheets

FIG 2
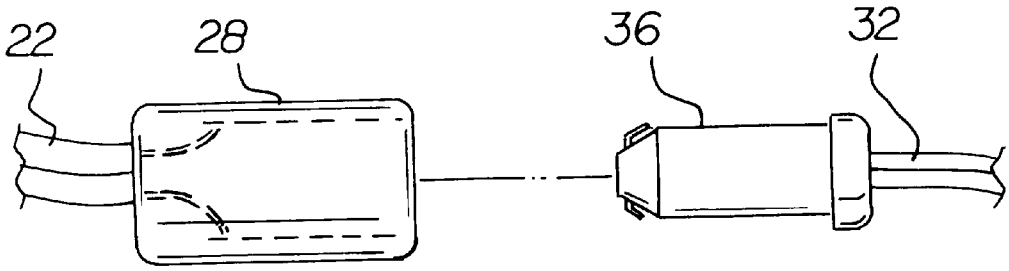
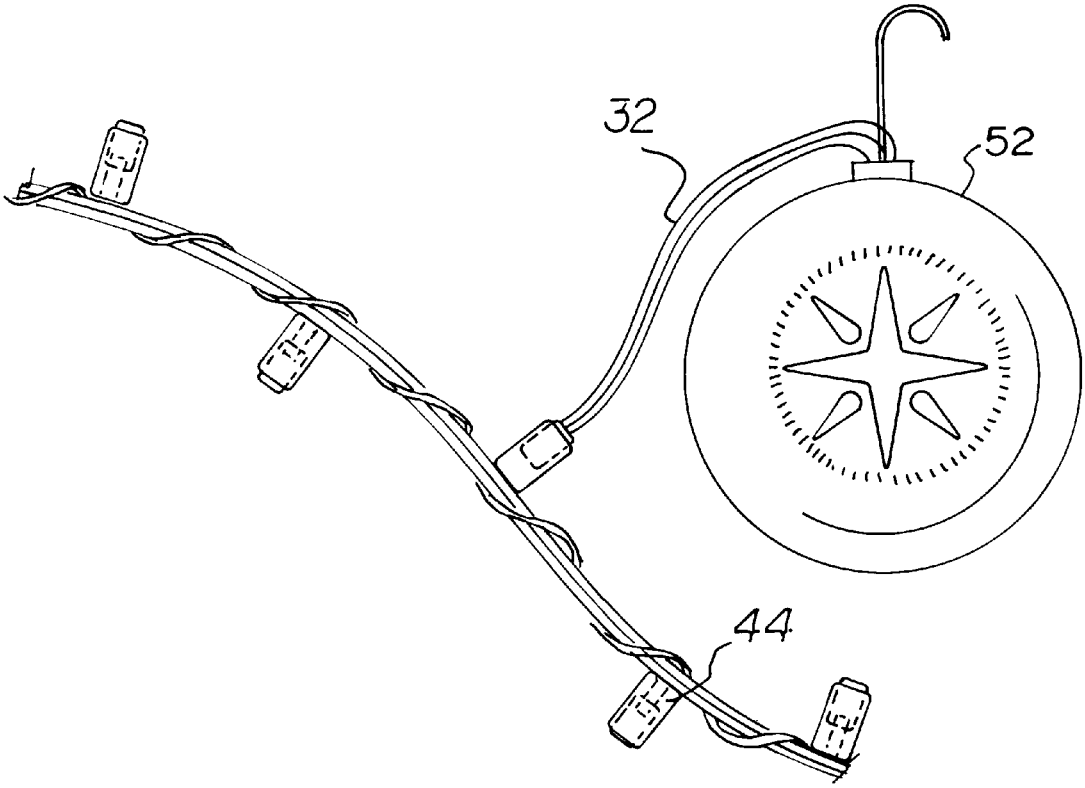
FIG 3

CHRISTMAS LIGHT EXTENSION CORD SYSTEM

BACKGROUND OF THE INVENTION

1. Field of the Invention

The present invention relates to a Christmas light extension cord system and more particularly pertains to extending the configurational capabilities of Christmas lights.

2. Description of the Prior Art

The use of Christmas lights of known designs and configurations is known in the prior art. More specifically, Christmas lights of known designs and configurations heretofore devised and utilized for the purpose of configuring the appearance of Christmas ornaments through various methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 5,234,360 to Kramer, Jr. discloses a Multiple Outlet Extension Cord. U.S. Pat. No. 4,544,218 to Sanders et al. discloses an Electrical Ornamentation System. U.S. Pat. No. 5,236,374 to Leonard et al. discloses an Extension Cord With Multiple Receptacles. U.S. Pat. No. 2,976,524 to Wall discloses an Electric Signaling System. International Application Number PCT/US93/05226 to Dickie discloses an Extension Cord Receptacle. European Patent Application Number EP 0 715 387 A1 discloses an Extension Cord With Multiple Sockets. U.S. Pat. No. 2,533,222 to Cohen discloses a Christmas Tree Lighting System.

In this respect, the Christmas light extension cord system according to the present invention substantially departs from the conventional concepts and designs of the prior art, and in doing so provides an apparatus primarily developed for the purpose of extending the configurational capabilities of Christmas lights.

Therefore, it can be appreciated that there exists a continuing need for a new and improved Christmas light extension cord system which can be used for extending the configurational capabilities of Christmas lights. In this regard, the present invention substantially fulfills this need.

SUMMARY OF THE INVENTION

In view of the foregoing disadvantages inherent in the known types of Christmas lights of known designs and configurations now present in the prior art, the present invention provides an improved Christmas light extension cord system. As such, the general purpose of the present invention, which will be described subsequently in greater detail, is to provide a new and improved Christmas light extension cord system and method which has all the advantages of the prior art and none of the disadvantages.

To attain this, the present invention essentially comprises a new and improved Christmas light extension cord system for extending the configurational capabilities of Christmas lights which consists of a first wire assembly with an electrical receptacle at one end and an electrical plug at the other end and with a plurality of wires for conveying electrical current therebetween. A fuse is located within the plug. A plurality of secondary wire assemblies each having an input end is electrically coupled to the primary wire assembly and an output end terminating in a female receptacle. The length of each second wire assembly is several times longer than the length of the female receptacle. A plurality of third wire assemblies, each having an input end with a male connector connected to a female receptacle of the second wire assembly and an output end terminate in a light with the length of each third wire assembly being several times longer than the male connector.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved Christmas light extension cord system which has all of the advantages of the prior art Christmas lights of known designs and configurations and none of the disadvantages.

It is another object of the present invention to provide a new and improved Christmas light extension cord system which may be easily and efficiently manufactured and marketed.

It is further object of the present invention to provide a new and improved Christmas light extension cord system which is of durable and reliable constructions.

An even further object of the present invention is to provide a new and improved Christmas light extension cord system which is susceptible of a low cost of manufacture with regard to both materials and labor, and which accordingly is then susceptible of low prices of sale to the consuming public, thereby making such Christmas light extension cord system economically available to the buying public.

Even still another object of the present invention is to provide a Christmas light extension cord system for extending the configurational capabilities of Christmas lights.

Lastly, it is an object of the present invention to provide a new and improved Christmas light extension cord system for extending the configurational capabilities of Christmas lights including a first wire assembly with an electrical receptacle at one end and an electrical plug at the other end and with a plurality of wires for conveying electrical current therebetween. Also provided is a plurality of secondary wire assemblies, each having an input end electrically coupled to the primary wire assembly and an output end terminating in a female receptacle. A plurality of third wire assemblies, each having an input end with a male connector connected to a female receptacle of the second wire assembly and an output end terminating in a light with the length of each third wire assembly being several times longer than the male connector.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an exploded side elevational view of the male and female connectors of FIG. 1 taken at circle 2 of FIG. 1.

FIG. 3 is a front elevational view of an alternate embodiment of the present invention.

The same reference numerals refer to the same parts through the various Figures.

DESCRIPTION OF THE PREFERRED EMBODIMENT

Figure 1:
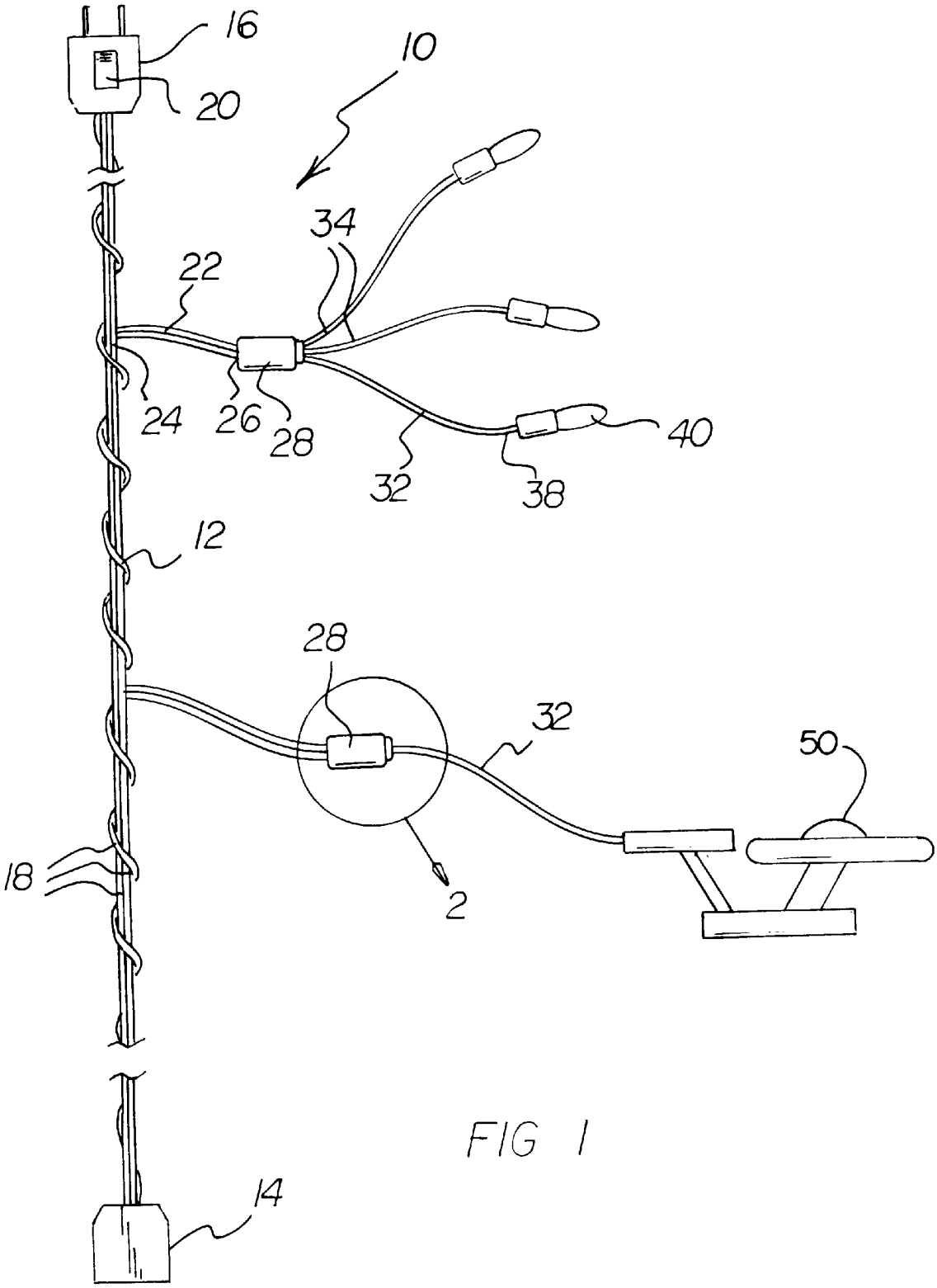
FIG. 1 is a perspective view of the preferred embodiment of the Christmas light extension cord system constructed in accordance with the principles of the present invention.

With reference now to the drawings, and in particular to FIG. 1 thereof, the preferred embodiment of the new and improved Christmas light extension cord system embodying the principles and concepts of the present invention and generally designated by the reference numeral 10 will be described.

The present invention, the Christmas light extension cord system 10 is comprised of a plurality of components. Such components are individually configured and correlated with respect to each other so as to attain the desired objective.

More specifically, the system 10 comprises a new and improved Christmas light extension cord system for extending the configurational capabilities of Christmas lights comprising a first wire assembly 12 with an electrical receptacle 14 at one end and an electrical plug 16 at the other end and with a plurality of wires 18 for conveying electrical current therebetween. In use, the electrical plug may be used to connect the system to an electrical outlet or to the electrical receptacle 14 of a first wire assembly of another Christmas light cord extension system.

The system includes a fuse 20 located within the plug.

Provided within the system is a plurality of secondary wire assemblies 22, each having an input end 24 electrically coupled to the primary wire assembly and an output end 26 terminating in a female receptacle 28, with the length of each second wire assembly being several times longer than the length of the female receptacle.

Lastly provided is a plurality of third wire assemblies 32, each having an input end 34 with a male connector 36 connected to a female receptacle of the second wire assembly and an output end 38 terminating in a light 40 with the length of each third wire assembly being several times longer than the male connector. The light may also optionally be configured to resemble an ornament such as a lighted space ship ornament 50 (FIG. 1)or a lighted traditional ornament 52 (FIG. 3).

An alternate embodiment of the invention as shown in FIG. 3 the length of the second wire assembly 44 is short as compared with that in the primary embodiment. The shortness may be sufficient that the female receptacle is essentially in contact with the primary wire assembly.

As described hereinabove, the system consists of a modified Christmas tree light string design for enabling multiple illuminated ornaments, such as those commercially available today, to be safely connected to the same string. In one embodiment, such a string could feature triple-headed light sockets in place of conventional single sockets. In use, this increased number of lights minimizes the impact of replacing a number of the lights with such ornaments, thereby enabling the power supplied to them to be kept under a safe limit. The system is also produced in a special lightless version. In this model, the individual sockets are fitted with dummy plugs or jumpers 54 as illustrated in FIG. 3.

The appealing features of the system are its ease of use, versatility, simplicity, attractive appearance, and the protection it provides. The two versions of this system could be set up with the same ease as conventional Christmas tree light strings. Unlike conventional light strings, this system does not allow excessive power levels to reach illuminated ornaments when more than three of the lighted or motion ornaments are connected to it, thereby preventing their sensitive electronics from damage.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A Christmas light extension cord system for extending the configurational capabilities of Christmas lights comprising, in combination:

a primary wire assembly with an electrical receptacle at one end and an electrical plug at the other end and with a plurality of wires for conveying electrical current therebetween;

a fuse located within the plug;

a plurality of secondary wire assemblies, each having an input end electrically coupled to the primary wire assembly and an output end terminating in a female receptacle, with the length of each secondary wire assembly being several times longer than the length of the female receptacle, the female receptacle having a substantially cylindrical body with a bore extending partially therethrough, the body having an open end for accessing the bore and a closed end such that the output end passes through the closed end and into the bore; and a plurality of third wire assemblies, each having an input end with a male connector connected to the female receptacle of one of the secondary wire assemblies and an output end terminating in a light with the length of each third wire assembly being several times longer than the male connector, the male connector having a substantially cylindrical main portion for insertion into the bore of the female receptacle of the secondary wire assembly, the main portion having a beveled end for facilitating the insertion of the main portion into the bore of the female receptacle of the secondary wire assembly, the input end of the third wire assembly extending through the main portion such that the input end protrudes through the beveled end of the male connector, the input end of the third wire assembly being in electrical communication with the output end of the secondary wire assembly upon complete insertion of the male connector of the third wire assembly into the female receptacle of the secondary wire assembly.

2. A Christmas light extension cord system comprising:

a primary wire assembly with an electrical receptacle at one end and an electrical plug at the other end and with a plurality of wires for conveying electrical current therebetween;

a plurality of secondary wire assemblies, each having an input end electrically coupled to the primary wire assembly and an output end, a female receptacle having a substantially cylindrical body with a bore extending partially therethrough, the body having an open end for accessing the bore and a closed end such that the output end passes through the closed end and into the bore; and a plurality of third wire assemblies, each having an input end detachably connected to the output end of one of the secondary wire assemblies and an output end terminating in a light, a male connector having a substantially cylindrical main portion for insertion into the bore of the female receptacle of the secondary wire assembly, the main portion having a beveled end for facilitating the insertion of the main portion into the bore of the female receptacle of the secondary wire assembly, the input end of the third wire assemblies extending through the main portion such that the input end protrudes through the beveled end of the male connector, the input end of the third wire assembly being in electrical communication with the output end of the secondary wire assembly upon complete insertion of the male connector of the third wire assembly into the female receptacle of the secondary wire assembly.

3. The system as set forth in claim 2 wherein a fuse is located within the plug.

4. The system as set forth in claim 2 wherein the length of each secondary wire assembly is several times longer than the length of the female receptacle.

5. The system of claim 2, wherein the length of each secondary wire assembly is generally equal to one another.

6. The system of claim 2, wherein the length of each secondary wire assembly is generally equal to the length of each third wire assembly.

7. The system of claim 2, wherein the wires of the primary wire assembly comprise at least 16 gauge wire.

8. The system of claim 2, wherein the input ends of the secondary wire assemblies are spaced apart along a length of the primary wire assembly.

9. The system of claim 8, wherein the input ends of the secondary wire assemblies are spaced apart at generally equal intervals along a length of the primary wire assembly.

* * * * *